United States Patent [19]

Studanski

[11] Patent Number: 4,644,928

[45] Date of Patent: Feb. 24, 1987

[54] COMPRESSION STRING BOW

[76] Inventor: Richard R. Studanski, 320 - 8th St. N.E., Sartell, Minn. 56377

[21] Appl. No.: 715,104

[22] Filed: Mar. 22, 1985

[51] Int. Cl.[4] ..... F41B 5/00

[52] U.S. Cl. ..... 124/24 R; 124/88

[58] Field of Search ..... 124/23 R, 24 R, 88, 124/DIG. 1; D22/5

[56] References Cited

U.S. PATENT DOCUMENTS

| | | | |
|---|---|---|---|
| D. 237,490 | 11/1975 | McArdle | D22/5 |
| D. 237,491 | 11/1975 | McArdle | D22/5 |
| 1,161,642 | 11/1915 | Enos, Jr. | 124/23 R |
| 2,736,309 | 2/1956 | Hoffman | 124/23 R |
| 3,794,012 | 2/1974 | Ramsey | 124/24 R |
| 3,942,506 | 3/1976 | Izuta | 124/24 R |
| 4,244,345 | 1/1981 | Simo et al. | 124/24 R |

*Primary Examiner*—Richard C. Pinkham
*Assistant Examiner*—Benjamin Layno
*Attorney, Agent, or Firm*—Kinney & Lange

[57] ABSTRACT

A compression string bow comprises a bow having a center portion including a forward handle grip, and limbs at the outer end of said center portion. The limbs have a string strung between the outer ends thereof. The center portion includes a compression carrying leg member between the outer ends of the handle, so that upon drawing the string, the compression carrying leg member is forced into compression to load the string in tension, and to give an action of a compound bow, that is, the draw force does not increase substantially as the bow approaches its full draw length.

7 Claims, 6 Drawing Figures

COMPRESSION STRING BOW

BACKGROUND OF THE INVENTION

1. Field of the Invention.

The present invention relates to archery bows.

2. Description of the Prior Art.

Various compound type bows have been advanced in the prior art which provide for pulleys and strings for maintaining a substantially uniform draw force (or reducing draw force) as the bow is drawn fully, so that while the bow string is being drawn to propel an arrow with substantial force, the archer does not have to increase the draw force substantially.

A wide variety of compound bows have been made using pulleys for the draw string.

Additionally, attempts have been made to design bows simulating the effect of a compound bow by use of a torsion element,, for example, as shown in U.S. Pat. No. 4,244,345 a torsion bar that is mounted immediately to the rear of the handle, and connected between the bowstring and the handle with a cam arrangement so that the torsion bar is loaded as the bow is drawn, to load the string in tension, other than in a linear relationship to draw distance.

Additionally, an archery bow with a collapsible bow armrest includes locking means that go between the bowstring and the handle portion of the bow is shown in U.S. Pat. No. 3,794,012 and this aids in maintaining the bow in a full drawn position so that the arm doesn't have to keep a full force on the bowstring when operating.

Other types of bows such as i.e. curved bows and compression spring bows, are shown in U.S. Pat. No. 1,161,642 where a spring is illustrated, and Design Patent DES No. 237,491, shows an archery bow formed out of a piece of metal that is recurved in form.

Additionally, Design Patent DES No. 237,490 shows a different type of archery bow having two curved hoops and a handle in the center of the hoops. These devices appear to be quite difficult to make.

Thus, the prior art fails to disclose a bow that provides an adequate load with a low draw or pull force, but yet is simple to make and does not involve complicated pulleys and the like.

SUMMARY OF THE INVENTION

The present invention relates to a bow which provides the advantages of a compound bow, that is not substantially increasing the draw load even when the string is at the full drawn position, but having a much simpler structure, without the need for pulleys and cables for obtaining a compound action.

The bow includes a compression member oriented adjacent the handle of the bow so that as the bow string is pulled and the limbs bend, the compression member will be loaded in compression and actually bow toward the handle. The mechanical advantage for loading and moving this compression member increases as the string is drawn, thereby not substantially increasing the draw load of the string. By proper arrangement the tension in the bow string remains increased as the bow is drawn.

The arrangement for the center section of the bow, which includes the handle and the compression member, simplifies the construction and can be made so that the bow is a takedown bow. That is, the outer limb portions of the bow can be removed from the handle for carrying and storage if desired, and quickly reinserted in place for use.

The bow can be made of laminated wood, or can be made of other flexible materials in a conventional manner. It even can have a construction such as that shown for the bow cross section in U.S. Pat. No. 4,088,111, which shows bow limbs having a construction that provides for increased loading per pound of draw because of the individual cross section configuration of the limbs.

The stored energy of the bow of the present invention at full draw is substantially greater than can be achieved with a standard, simple bow, which is made to have the same draw load to hold the bow at the full draw position.

Thus the advantages of simple construction, of high arrow propelling force, and low draw force for equivalent propelling force is achieved.

DETAILED DESCRIPTION OF THE PREFERRED EMBODIMENTS

Figure 1:
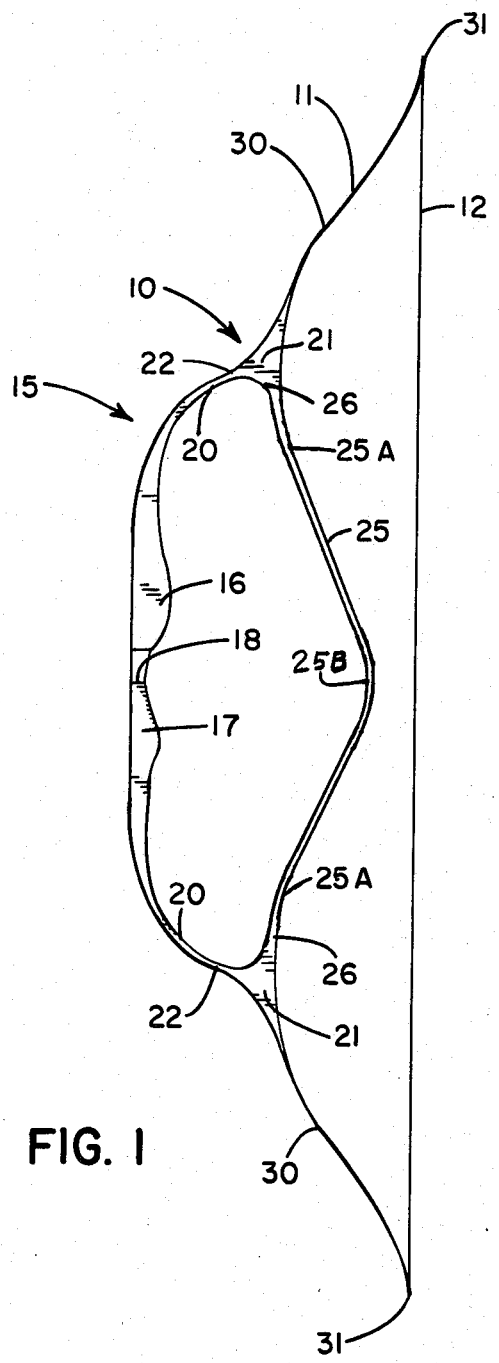
FIG. 1 is a side elevational view of a bow made according to the present invention.
Figure 2:
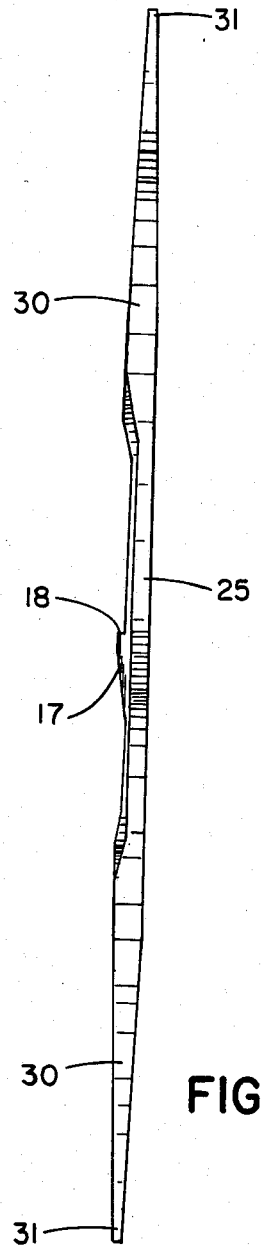
FIG. 2 is a rear view thereof with the bowstring removed.

The compression string bow shown generally at 10 includes a bow assembly 11, and a bowstring 12. The bow 10 provides the compound action, without the need for cables, pulleys and/or recurve features. As shown, the bow assembly 11 has a center portion 15 which has a forward handle section 16 that is relatively sturdy, and includes a grip member 17 and an arrow rest notch 18 on the side thereof in a conventional manner. The center section comprising the handle section 16 has curved upper ends 20 which curve in a bow form in direction generally back toward the bowstring 12, and which are found to junction block portions 21, 21 which are quite massive and form limb support blocks.

The outer ends of the curved portions 20 are relatively thin, and form hinge sections 22, 22 between the handle 17 and the support block portions 21. The support block portions 21 are generally triangular shaped. A compression loading leg 25 is connected as at 26 to one point of each block portion. The compression leg 25 extends between the opposite block portions 21, and forms a part of the central portion 15 of the bow. The compression leg 25 is of larger cross section and relatively rigid adjacent the block portions generally in the regions shown at 25A, and is thinner but has compression carrying abilities in a center portion 25B. As shown, at rest the compression leg is generally recurved that is curved back toward the bowstring 12.

The bow 11 includes limb sections 30 that extend out from the opposite ends of the center portion 15 and which are integral with the block portions 21, and extend outwardly therefrom. The limbs 30 are curved in a desired shape. At the outer ends of the bow limbs 30 the string 12 is attached in a conventional manner as at 31.

Figure 4:
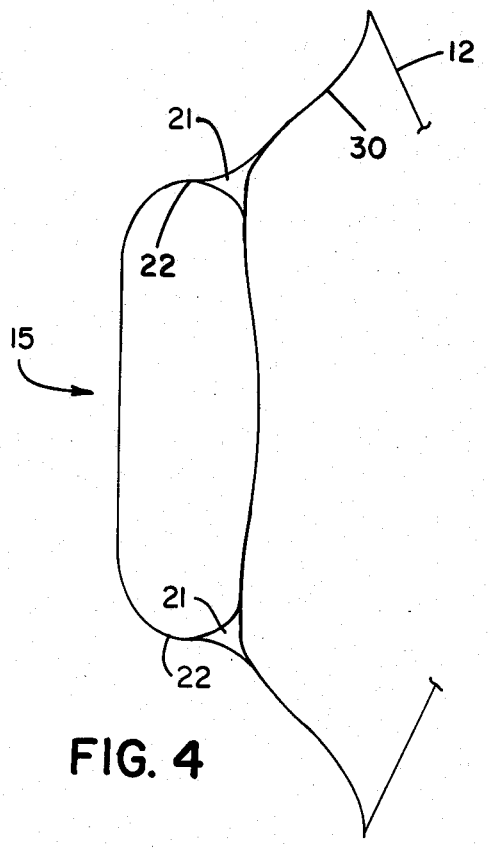
FIG. 4 is a schematic side view showing the bow in a partially drawn position.
Figure 5:
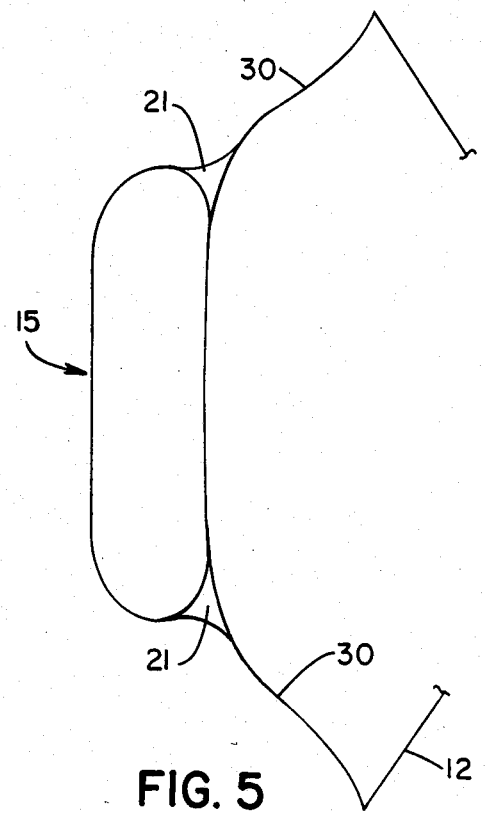
FIG. 5 is a schematic representation of the bow in a fully drawn position.

When the string 12 is drawn in a normal manner while the handle 17 is being gripped, the limbs 30 of course will move rearwardly generally to positions shown in FIG. 4 at an intermediate draw position. It can be seen that the block portions 21 tend to pivot about a pivot axis in the hinge areas 22 relative to the handle portion. As these block portions pivot, the relatively rigid sections 25A of the compression leg 25 cause the compression leg center portions 25B to tend to move toward the handle, that is away from the bowstring. This places the compression leg 25 in compression, thereby storing energy, and because the mechanical advantage or lever arm action on the blocks 21 between the effective hinge axis of the hinge portions 21 and the limbs 30 the force from the load on the limb portions 30 from the bowstring 12 as it is drawn effectively increases the load on the compression leg 25 as the leg moves toward a straight line position with respect to its mounting. The block portions 21 have to separate as the compression leg straightens out. Thus, the handle 16 and the curved portion 20 are loaded at the same time.

The leverage or mechanical advantage increases as the bow portion approaches the center line between the effective hinge axes at the hinge portions 22. The compression member 25 preferrably does not go over center with respect to the hinge axes, but rather approaches the center line position. The end coupling areas 26 to the compression leg as can be seen moves toward a line that lies between the hinge portions 22. Additionally, as stated, the block portions 21 spread apart about these hinge axes further storing energy in the compression leg 25 as well as in the handle portion 16 and the limbs 30 in a conventional manner.

Figure 3:
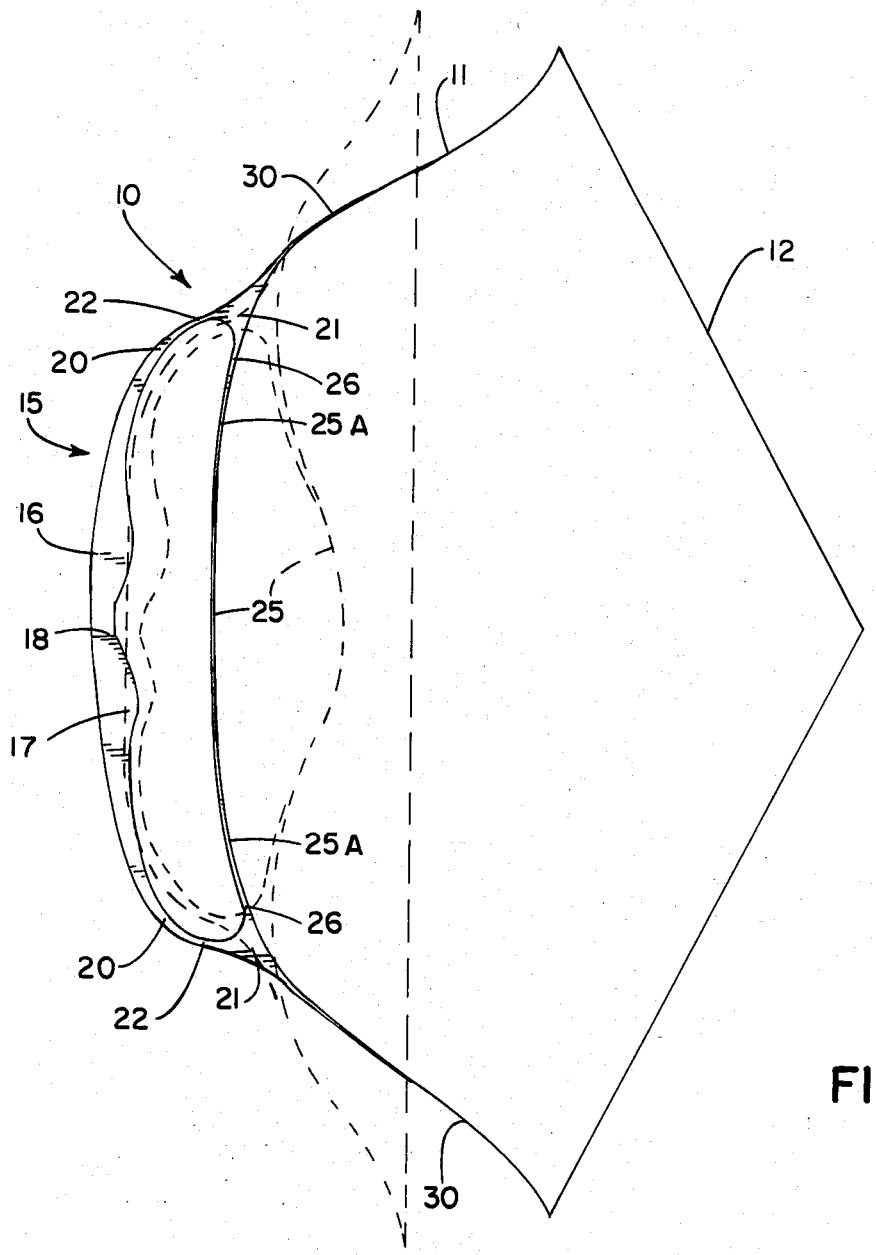
FIG. 3 is a view similar to FIG. 1 show the bow in two superimposed positions of operation.

The load on the compression leg 25 causes the block portions 21 to spread apart as shown in the representations in dotted lines in FIG. 3, where the solid line position shows the full drawn portion of the bow, with approximately a 31 inch draw.

Upon release of course the stored energy in the compression leg 25, and other parts of the bow propel the arrow due to the tension in the bowstring 12.

The bow can be made of any desired material such as flexible fiberglass or wood that is laminated. It is important that the blocks are rigid and the ends 20 of the handle can pivot or hinge so that the blocks 21 can move outwardly as the compression leg is forced inwardly. It is therefore also important that the compression leg 25 is made such that it does not merely tend to bow further toward the bowstring as the bow is drawn, but that the rigid end sections 25A force the center part of the compression leg toward the handle as the bowstring is drawn.

Figure 6:
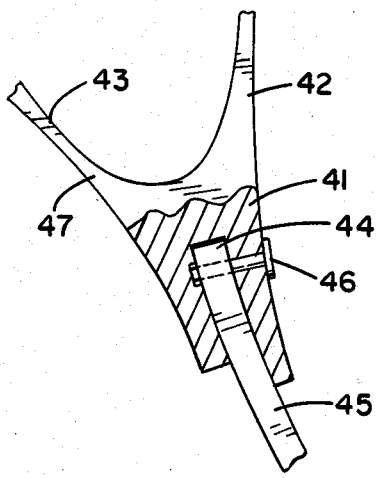
FIG. 6 is a enlarged sectional view of a modified version of the bow illustrating a removable limb installed on the bow.

As shown in FIG. 6, the blocks 21 can be made in a different configuration for a take down feature. As shown, the bow block portions can be modified. The block portions indicated at 41 in FIG. 6 are connected to a compression carrying leg 42, and to a handle portion 43 attached thereto in a normal manner as previously described, and accomplishing the purposes previously described. However, the main part of the block 41 is modified in shape and includes a receptacle 44 which will receive the end portion of a limb 45 of the bow. This will be a tight fit to prevent "working" of the connection, and in addition a pin indicated at 46 can be provided for holding the limb 45 in place. Once the pin 46 is removed the limb 45 can be also removed. With both limbs mounted in this manner the bow can be "knocked down" the size of the center section of the bow for easy transport. However, the block 43 will still hinge in the area 47, and the compression leg 42 will provide additional loading action that is necessary.

The block can be made of suitable length and size to ensure that it doesn't break when the bow is drawn fully and is held securely in position during use.

What is claimed is:

1. A bow for archery comprising, in combination:

a bow frame having a central section, and outer limb sections extending from opposite ends of said central section, said outer limb sections having end portions adapted to mount a bow string between the opposite ends under tension;

said central section comprising a frame having an elongated hand grip member and a pair of rigid mounting blocks, one at each end of the elongated hand grip member, each block being connected to the hand grip member at first locations by flexible hinging sections only, each block having one of the limb portion connected thereto at a second location spaced from the connection of the respective hinging sections; and a resilient leg extending between the rigid mounting blocks and joined to the blocks at third locations spaced from the first and second locations; and said leg being bowed in a curve toward the bow string in a relaxed position of said bow, said string being capable of being drawn away from said handle portion to move the end portions of said limbs away from the central section, and to pivot the mounting blocks at the hinge connections relative to said hand grip member to cause the second locations to move together to tend to move the resilient leg toward the handle grip member to create a force tending to force the said mounting blocks and said limbs apart.

2. The apparatus as specified in claim 1 wherein said limbs and said mounting blocks are made integrally, and the resilient leg causes pivoting of the blocks at the hinge sections at the ends of the handle as said leg straightens out under compression load.

3. The apparatus as specified in claim 1 wherein said frame hand grip member has an arrow rest portion defined along the sides of said hand grip portion.

4. The apparatus as specified in claim 3 wherein said limbs and said frame are made of a light-weight material.

5. The apparatus as specified in claim 4 wherein said limbs and said frame are made of laminated wood.

6. The apparatus as specified in claim 3 wherein said limbs are removably attached to said mounting blocks and said frame and said leg are made as a unit with said mounting blocks being massive relative to the portions of the frame that are immediately adjacent the hinge sections.

7. A compression string bow comprising:

a bow handle having a grip in the center portions thereof, and spaced apart oppositely extending ends forming mounting blocks hingedly connected to the opposite ends of the handle with separate flexible hinge connections, said handle bowing at its outer end in a first direction;

said bow comprising outwardly extending limbs mounted to the mounting blocks at the outer ends of said handle, said hinge connections permitting forming pivoting areas for easy pivoting of the mounting blocks and the limbs;

a compression carrying leg connected to both of the mounting blocks, said leg being curved away from said handle in said first direction, to extend farther away from said handle than the mounting blocks;

means at the opposite end of the limbs from the mounting blocks to support the ends of a draw-string;

said handle, said leg and said limbs lying generally along a central draw plane for said draw string, said draw string being capable of being drawn away from said handle, so that the mounting blocks hinge at said hinge connections at the ends of said handle to pivot and force the leg to go into compression as the limbs are moved to tend to straighten out the leg and move it toward said handle to thereby exert a compound force tending to force the mounting blocks apart and create tension load in said string.

* * * * *